United States Patent [19]

La Pointe

[11] 3,948,426

[45] Apr. 6, 1976

[54] FASTENER DRIVER WITH SAFETY DEVICE

[75] Inventor: Gabriel M. La Pointe, Worcester, Mass.

[73] Assignee: Parker Manufacturing Co., Worcester, Mass.

[22] Filed: Jan. 20, 1975

[21] Appl. No.: 542,409

[52] U.S. Cl. ..... 227/8; 227/132

[51] Int. Cl.[2] ..... B25C 5/06

[58] Field of Search ..... 227/8, 132

[56] References Cited

UNITED STATES PATENTS

| | | | |
|---|---|---|---|
| 3,131,397 | 5/1964 | Miller | 227/132 |
| 3,862,712 | 1/1975 | La Pointe et al. | 227/132 X |

*Primary Examiner*—Granville Y. Custer, Jr.

*Attorney, Agent, or Firm*—Norman S. Blodgett; Gerry A. Blodgett

[57] ABSTRACT

Driver for fasteners, wherein a slidable element contacts a work surface to allow fasteners to be driven, but otherwise inhibits the driving of fasteners.

2 Claims, 4 Drawing Figures

FASTENER DRIVER WITH SAFETY DEVICE

BACKGROUND OF THE INVENTION

For many years mechanical devices have been used for driving fasteners in the construction trades. For instance, stapling guns have been used for driving staples and nail drivers have been used for driving nails. These devices project the fastener with considerable force and, in the absence of a work surface, the fasteners fly through the air considerable distances and with considerable force. Since all such fasteners are provided with sharp ends, the fastener driver becomes a very dangerous piece of equipment. In the construction trades, however, the workers are aware of these dangers and tend to be careful in handling such equipment, because it is their livelihood. Stapling guns and nail drivers are now being used, however, by homeowners in performing repairs around their houses and, therefore, the fastener driver becomes available to children. Because they are often shaped to resemble guns, they become an attractive nuisance so far as children are concerned. The danger to themselves and to other children increases as such devices become more readily accessible to children and as the children become more used to them. These and other difficulties experienced with the prior art devices have been obviated in a novel manner by the present invention.

It is, therefore, an outstanding object of the invention to provide a fastener driver which is not capable of projecting the fastener through the air.

Another object of this invention is the provision of a fastener driver which is only operative to drive fasteners when it is pressed against a work surface.

A further object of the present invention is the provision of a driver for fasteners wherein the fasteners are carried in a cartridge but are inhibited from entering the driving area unless the fastener-emitting exit is pressed against a work surface.

It is another object of the instant invention to provide a fastener driver in which the fasteners are arranged seriatim, so as to be advanced one by one to a driving position, and wherein the advance is inhibited unless the driver is in a safe condition.

With these and other objects in view, as will be apparent to those skilled in the art, the invention resides in the combination of parts set forth in the specification and covered by the claims appended hereto.

SUMMARY OF THE INVENTION

In general, the invention consists of a driver for fasteners having a housing with a handle and with a fastener exit. A track is mounted in the housing for supporting the fasteners to present them one by one to the said fastener exit and means is mounted in the housing for driving a fastener through the exit. A safety device mounted on the housing serves normally to inhibit the driving of a fastener and allows it only when the exit is pressed against a surface.

More specifically, a driving blade extends outward through the exit and not only prevents fasteners from entering the work area but also prevents operation of a driving hammer unless the blade is pressed back through the exit by a work surface adjacent the exit. Movement of the blade allows engagement of a recess on the hammer by an actuating lever.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
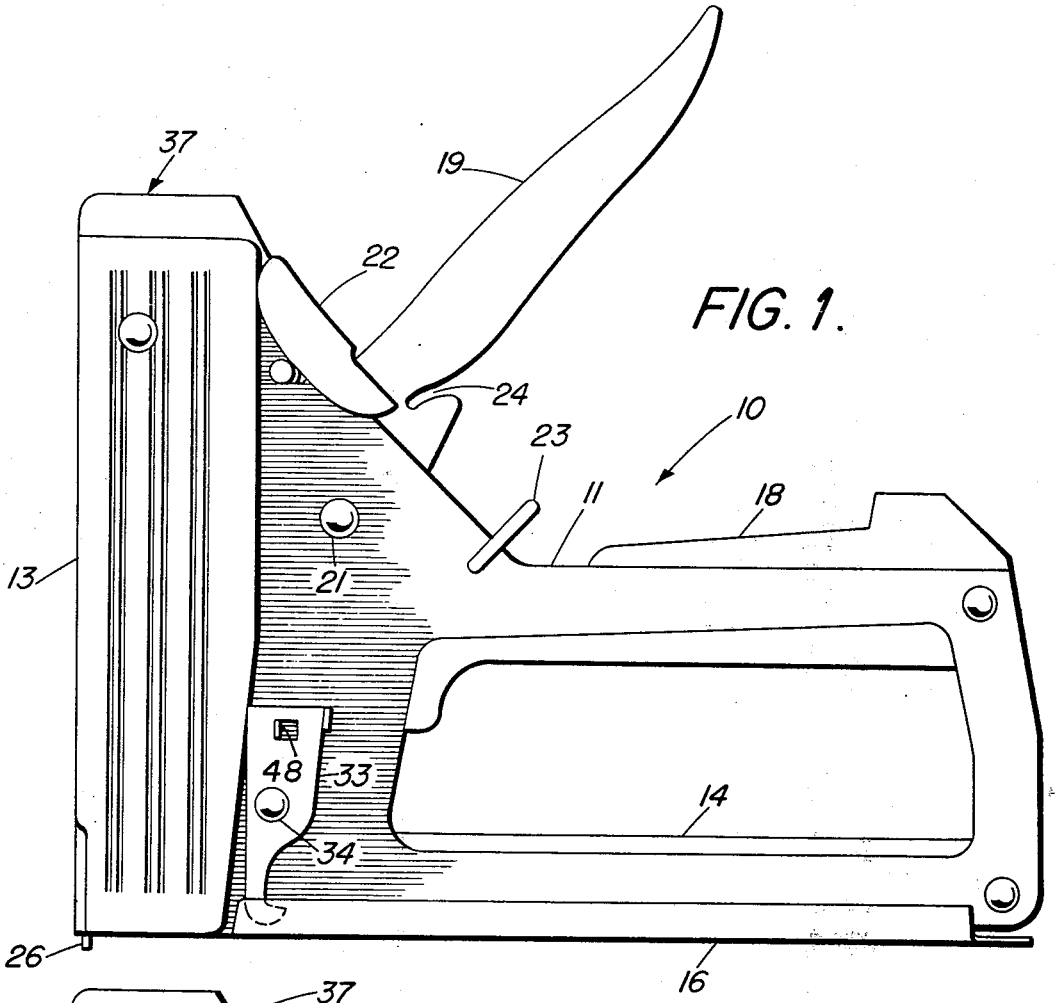
FIG. 1 is a side view of a driver for fasteners embodying the principles of the present invention.
Figure 2:
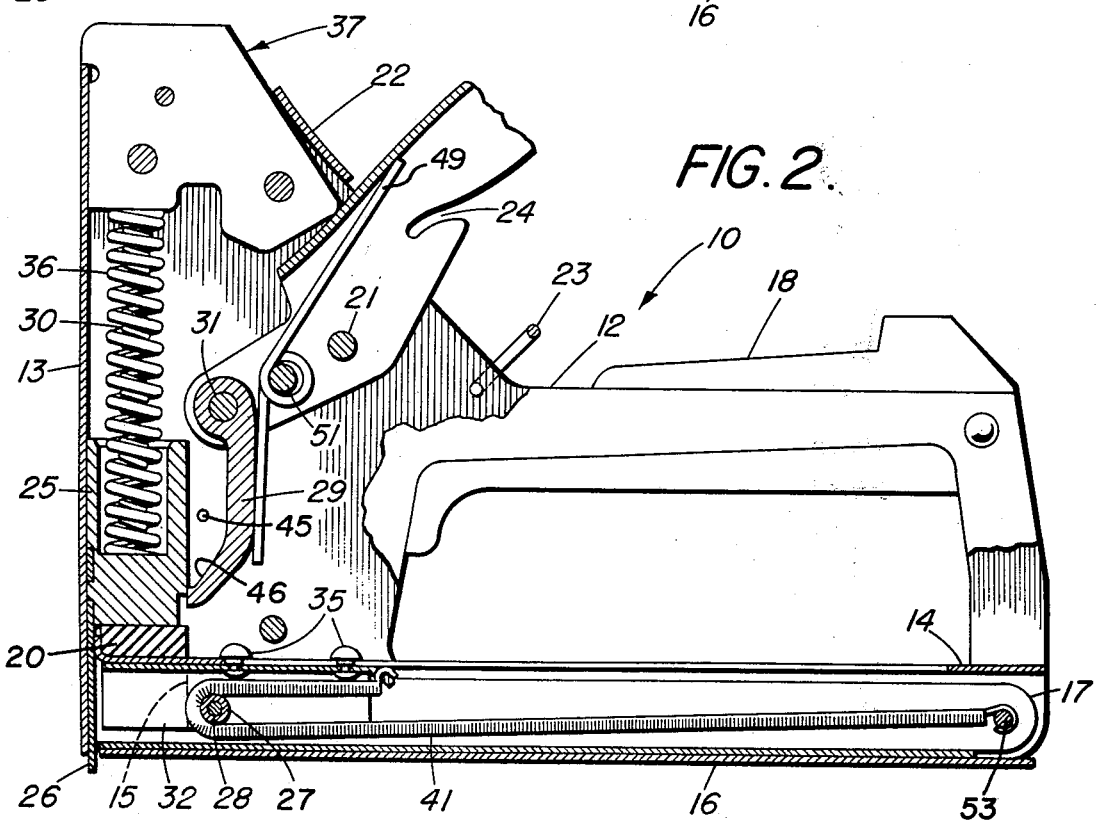
FIG. 2 is a vertical sectional view of the driver showing details of the construction.

Referring first to FIGS. 1 and 2, wherein are best shown the general features of the invention, the driver 10 is shown for the purpose of illustration as a stapling gun for driving fasteners in the form of staples. It is formed with two spaced, parallel side frames 11 and 12 which are embraced along corresponding normally-vertical straight edges by a U-shaped front frame 13. The side frames are held in spaced parallel relationship by a frame channel 14 running along corresponding bottom edges. Bumper retainers 15 (FIG. 2) are also located between the side frames and the unit is provided with a base 16. The staple guide 17 is located within the frame channel 14. A plastic handle 18 is located between the side frames. An actuating handle 19 is pivoted between the side frames on a pivot pin 21 and a shield 22 is mounted on the handle. A lock loop 23 is pivoted on the side frames and is adapted to engage a slot 24 formed in the handle. A driving hammer 25 is located between the side frames within the front frame 13 and is provided with a staple or driving blade 26 fastened thereto and resting against the bight of the U-shaped front frame 13. A spring guide roller 27 is mounted within the staple guide 17 and is rotatably mounted on a spring guide roller pin 28. A lever or hammer lifter 29 is mounted on a pivot pin 31 as a lever between the side frames 11 and 12 and between downwardly-depending flanges formed on the actuating handle 19. A latch 33 is mounted on the outside of each of the side frames by means of a pivot pin 34. A staple-pressure slide 32 is mounted in the staple guide 17. The slide 32 is guided in a slot in the frame channel 14 by means of slide rivets 35. Hammer springs 30 and 36 rest in an upwardly-directed recess formed in the top of the hammer 25.

Between the side frames 11 and 12 and within the front frame 13 is also mounted a cap member 37 consisting of outside laminations within which are provided spring-confining laminations. There are also five lifter cam laminations which are located between the spring-confining laminations. A latch spring 48 is associated with the latch 33, while a lifter spring 49 is mounted on a pivot pin 51 in the handle 19. A staple feed spring 41 is mounted within the staple guide 17 and has one end attached to a hinge pin 53, while the other end is attached to the slide 32. A rubber bumper 20 is mounted on the upper side of the frame channel 14 and underlies the hammer 25.

Figure 3:
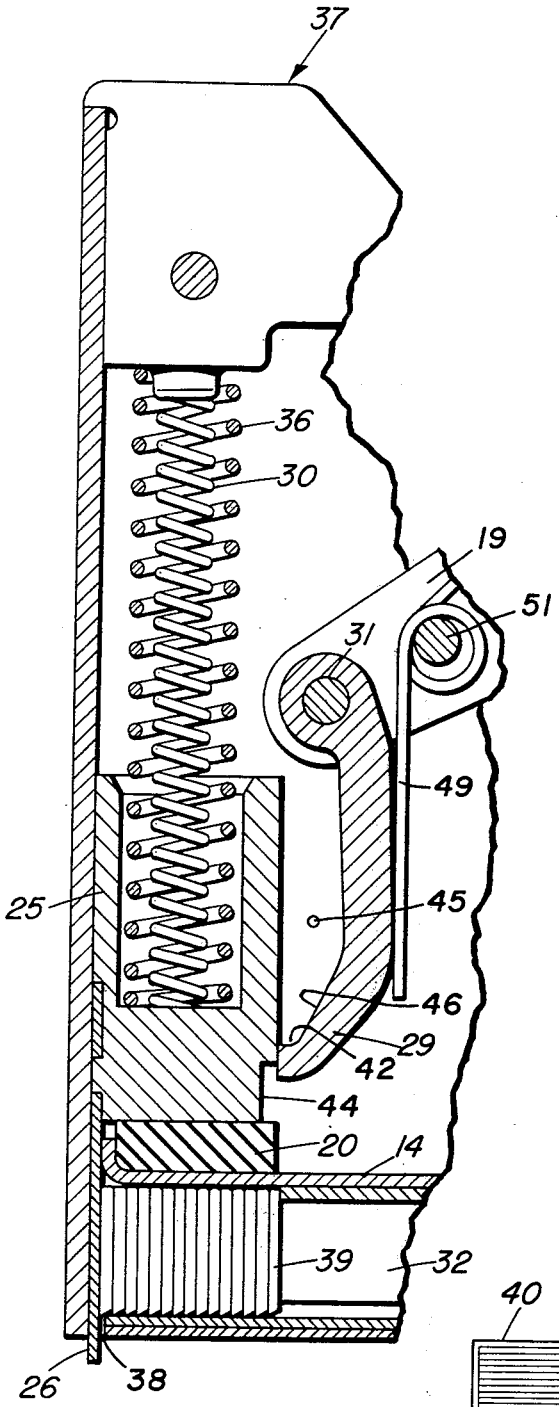
FIG. 3 is an enlarged vertical sectional view of the driver showing the details of the safety device in a "safe" condition.
Figure 4:
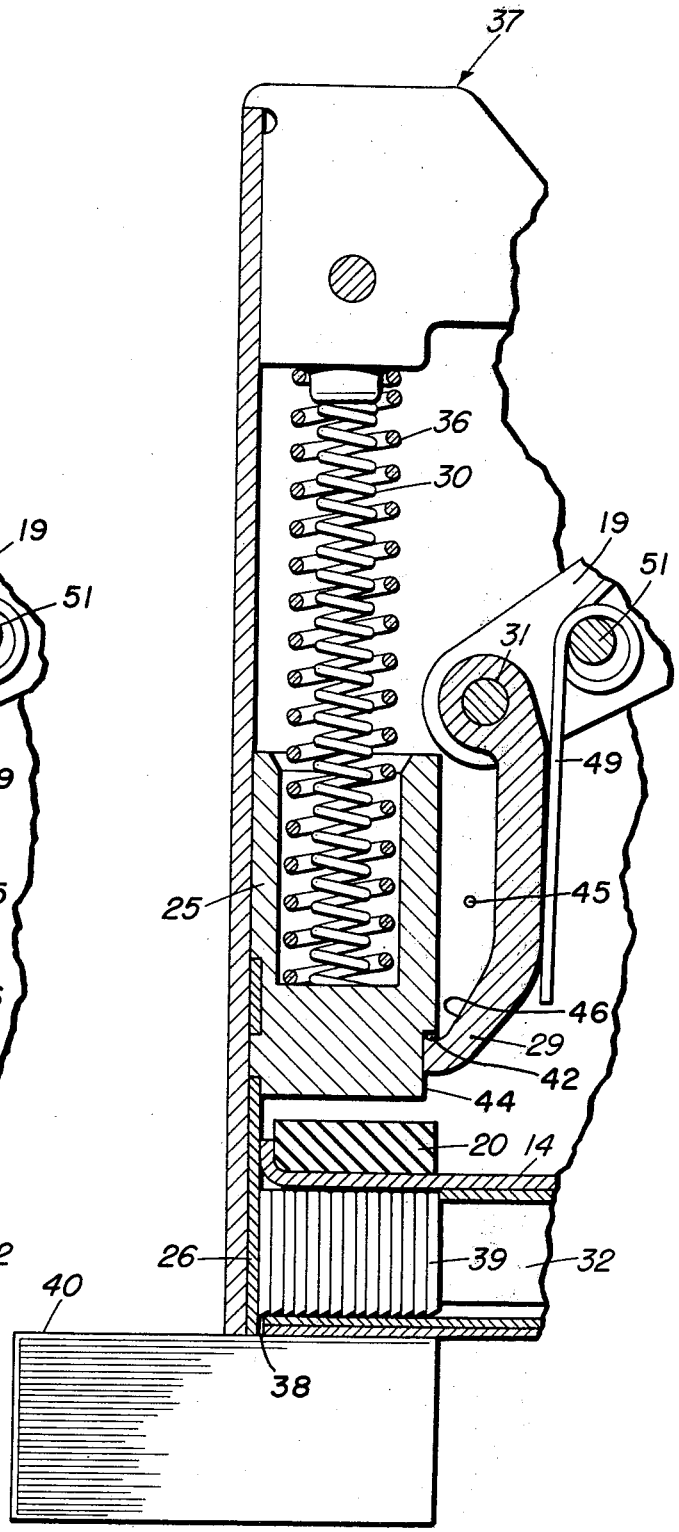
FIG. 4 is an enlarged vertical sectional view of the driver showing the details of the safety device in a "working" condition.

Referring next to FIGS. 3 and 4 wherein are shown the details of the safety device, it can be seen that the fastener exit is indicated by the reference numeral 38 and that the staples 39 are mounted on a track in the housing which supports them to present them seriatim to the said fastener exit 38. The hammer 25 including blade 26 provides a means mounted in the housing for driving a fastener through the exit. A safety system normally inhibits the driving of a staple, but allows such driving to take place when the area around the exit 38 is pressed against a working surface. The safety system includes the hammer 25 and the blade 26 which extends away from the bottom wall of the base 16 through the exit 38 and which slides in accordance with movement of the housing toward and away from the working surface.

The hammer and blade are biased by the springs 30 and 36 into position where the blade extends through the exit and inhibits the driving of a staple, but can be moved into a retracted position by contact with the working surface, in which position it allows the driving of the fastener. A lever system, including the lifter 29 and the handle 19, is provided to lift the hammer and then release it for the driving operation.

The connection between the lifter 29 and the hammer 25 occurs between a recess 44 in the hammer and a pawl surface 42. As shown in FIG. 3, in its first state or starting position toward which the driver is biased, the recess is not available to the pawl surface and no connection results. This first state is characterized by the blade 26 passing outwardly through the exit 38 and the hammer contacting the bumper 20.

As shown in FIG. 4, the driver is in a second state characterized by the work surface being adjacent the exit 38 and thereby forcing the blade 26 inwardly through the exit. This inward movement lifts the hammer off of the bumper and allows the pawl surface 42 to engage the recess 44. A releaser 45 is connected between the side frames 11 and 12 and engages a cam surface 46 on the lever when the handle is operated.

The operation of the fastener driver will now be readily understood in view of the above description. The driver is operated in the usual way by grasping the handle 18 and squeezing the actuating handle 19 toward it from the handles starting position to which it is biased. This lifts the hammer 25 by means of the lifter or lever 29 against the pressure of the springs 30 and 36 but only if the pawl surface 42 of the lever 29 has engaged the recess 44. Otherwise the lever simply moves up and down without effect. At the top of the stroke the lever 29 is moved out of the recess in the hammer by the engagement of the releaser 45 with the cam surface 46 and the hammer is driven downwardly, carrying the staple blade 26 with it. This blade usually strikes the foremost of the staples 39 and drives it outwardly through the opening 38.

FIG. 3 shows the driver in its starting position and in a first or "safe" state. The blade 26 extends out of the exit 38 and the pawl surface 42 cannot engage the recess 44 on the hammer 25. In FIG. 4 the driver has been pushed against a work surface causing the blade 26 to be pushed inward through the exit 38 placing the driver in the second or "working" state. The blade raises the hammer 25 from the bumper 20 and as a result the recess 44 becomes engaged by the lifter. Operations of the actuator handle 19 lifts the hammer against the spring 36. Eventually, the cam surface 46 of the lifter 29 contacts the releaser 45 and the pawl surface 42 is disengaged from the recess, allowing the hammer and the blade to drive a fastener through the exit. Release of the handle allows the lifter to return to its original position where engagement of the recess depends again on the state of the driver.

It can be seen that the present invention causes the driving of a staple to be inhibited unless the bottom surface of the base 16 is pressed against the working surface. In other words, it is impossible to drive a staple into the air. A child playing with the stapling gun will not be able to "shoot" staples and injure himself or his playmates. Furthermore, a workman cannot accidentally fire the staple and do similar damage. The construction is relatively simple and inexpensive to apply to existing driver designs and can be used either on stapling guns or on nail drivers of the conventional type.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A driver for fasteners, comprising a. a housing having a handle and a fastener exit, b. a magazine mounted in the housing for presenting the fasteners seriatim to the said fastener exit, c. means mounted in the housing for driving a fastener through the exit into a surface, said means including a spring-loaded hammer with a driver blade adapted to strike the fastener, the hammer being slidable between a second position relatively close to the exit and a first position relatively far from the exit, d. an actuator which is operable to cause the said driver blade to strike said fastener when the hammer is in the second position but which operation does not effect the hammer when the driver blade is in the first position, the actuator including a lifter which is provided to lift the hammer and then release it for the driving operation, the blade extending out of the exit when the hammer is in the second position, and lying substantially entirely within the housing at the exit when the hammer is in the first position, and e. a spring mounted in the housing and normally holding the hammer in the second position but allowing the hammer to move to the first position when the fastener exit is pressed against a surface, the hammer including a recess and the lifter being biased toward a starting position in which it engages the recess when the driver is in its first position and does not engage the recess when the driver is in its second position, the pressing of housing and the exit against the surface pushing the blade which in turn moves the hammer to the first position at which the recess can be engaged by the lifter.

2. A driver as recited in claim 1, wherein a releaser forming part of the housing is provided to disengage the lifter from the recess as the actuator is operated.

* * * * *